US007191975B2

(12) United States Patent
Takahashi et al.

(10) Patent No.: US 7,191,975 B2
(45) Date of Patent: Mar. 20, 2007

(54) TAPE WINDING APPARATUS

(75) Inventors: Hisashi Takahashi, Odawara (JP); Akihisa Kita, Odawara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 38 days.

(21) Appl. No.: 11/209,661

(22) Filed: Aug. 24, 2005

(65) Prior Publication Data

US 2006/0043229 A1 Mar. 2, 2006

(30) Foreign Application Priority Data

Aug. 24, 2004 (JP) ..... 2004-244290

(51) Int. Cl.
*B65H 23/04* (2006.01)

(52) U.S. Cl. ..... 242/548.3; 242/908

(58) Field of Classification Search ..... 242/547, 242/534, 548, 548.3, 548.4, 908
See application file for complete search history.

(56) References Cited

U.S. PATENT DOCUMENTS 4,789,110 A * 12/1988 Sakaguchi et al. ..... 242/548.4
4,932,600 A * 6/1990 Usui et al. ..... 242/548.4
5,547,146 A * 8/1996 Kita ..... 242/548.4
6,719,238 B1 * 4/2004 Grant et al. ..... 242/548.4
6,854,683 B2 * 2/2005 Hayashi et al. ..... 242/548.3

FOREIGN PATENT DOCUMENTS

JP 63-277163 * 11/1988
JP 6-329308 A 11/1994

* cited by examiner

*Primary Examiner*—William A. Rivera
(74) *Attorney, Agent, or Firm*—Sughrue Mion, PLLC

(57) ABSTRACT

In the tape winding apparatus of the present invention, the recessed blowout part is formed at the tip end part of the nozzle and a plurality of slits are disposed at the blowout part. Therefore, the range where the sprayed gas presses the tape becomes wide, and the entire force which presses the tape becomes strong. Thereby, a constant biasing force can be applied to the outer peripheral surface of the tape roll, as a result of which, the tape roll of favorable quality can be obtained.

23 Claims, 15 Drawing Sheets

TAPE WINDING APPARATUS

BACKGROUND OF THE INVENTION

1. Field of the Invention

The present invention relates to a tape winding apparatus, and particularly relates to a tape winding apparatus preferable for winding up a band-shaped substance such as a magnetic tape in a roll form around a winding shaft.

2. Description of the Related Art

As an art for winding up a band-shaped substance such as a magnetic tape in a roll form around a winding shaft, various kinds of improved arts are conventionally proposed, and the corresponding effect is obtained.

For example, the winding apparatus described in Japanese Patent Application Laid-Open No. 6-329308 includes a contact pressure roll which rolls in contact with an outer peripheral surface of a tape roll at a time of winding, an air pressure device which sprays air onto the outer peripheral surface of the tape roll at the time of winding, and movable part moving device which displaces the contact pressure roll and the air pressure device in accordance with a winding diameter of the tape roll, and is constructed so as to make winding tightness constant by cooperation of the contact pressure roll and the air pressure device irrespective of the winding diameter of the tape roll.

FIG. 13 is a perspective view showing a winding apparatus 200 for a tape of a related art. The winding apparatus 200 has a reel (corresponds to the winding shaft) 12, and the reel 12 is connected to a motor not shown. The reel 12 rotates by driving the motor, and a tape 14 is wound up around the outer peripheral surface of the reel 12. Thereby, a tape roll 15 is formed.

A nozzle 216 is disposed to oppose an outer peripheral surface of the tape roll 15. FIG. 14 is a sectional view of the nozzle 216 shown in FIG. 13, and FIG. 15 is a sectional view of the nozzle 216 taken along the B—B line in FIG. 14. As shown in FIG. 14 and FIG. 15, an opening 216A is formed in a tip end of the nozzle 216. The opening 216A is formed in an elongated slit shape in a width direction of the tape 14, and its size is formed corresponding to the size of the tape 14. A depth d in a slit shaped part of the opening 216A is formed to be the size of 0.5 to 3.0 mm, for example.

A hose 218 is connected to a rear end side of the nozzle 216. The hose 28 is connected to an air supply source not shown, and air is supplied to the hose 218 from this air supply source. Besides, flow passages 216B and 216C for providing communication between the nozzle 216 and the hose 218 are formed inside the nozzle 216. The flow passage 216B is a hole with the same diameter as the inner diameter of the hose 18, and the flow passage 216C is formed so that pressure loss between the flow passage 216B and the opening 216A becomes small. Namely, the flow passage 216C becomes gradually smaller in a dimension in a lateral direction to be a slit space g of the opening 216A, and as shown in FIG. 15, a dimension in a longitudinal direction becomes gradually large to be a dimension of a width W of the opening 216A.

When air is supplied to the nozzle 216 formed as described above from the hose 218, the air is sprayed toward the outer peripheral surface of the tape roll 15 from the opening 216A of the nozzle 216 through the flow passage 216B and the flow passage 216C.

SUMMARY OF THE INVENTION

However, in such a winding apparatus, when the air pressure applied onto the tape roll varies, various troubles occur. For example, when the air pressure becomes small, an amount of air which is wrapped up in the tape increases, and therefore, there arise the problems that contact pressure in a radius direction in the tape roll becomes low, and the edge of the tape which is wound up becomes uneven. When the air pressure becomes large on the other hand, winding tightness becomes large, and an adverse effect such as tape edge damage occurs to the quality.

For this, improvement in which a recessed blowout part is provided at a tip end part of the nozzle is considered to be an effective countermeasure. Namely, a nozzle of a construction in which a throttle part which is a gas flow passage of a predetermined sectional area is provided inside the nozzle, a tip end part of the nozzle is a recessed blowout part with a larger sectional area than the sectional area of the throttle part, and the blowout part and the throttle part communicate with each other.

According to this improvement idea, the tip end part of the nozzle becomes the recessed blowout part of a larger sectional area than the sectional area of the throttle part, and therefore, the range in which the sprayed gas presses the tape becomes wide, and the entire force with which the tape is pressed becomes strong. This makes it possible to apply a constant biasing force to the outer peripheral surface of the tape roll, as a result of which, it is expected that the tape roll of favorable quality can be obtained.

However, though the biasing force can be increased with this improvement idea, the tape flaps and a favorable winding state is not achieved. As the cause of this, it is conceivable that when air flows into the recessed blowout part from the throttle part, the air diffuses to cause a negative pressure part at the blowout part, and stable biasing cannot be performed.

On the other hand, if the area of the blowout part is decreased, such a part with negative pressure is not caused, but the biasing force becomes insufficient, and the tape roll of favorable quality cannot be obtained.

The present invention is made in view of the above circumstances, and has its object to provide a tape winding apparatus that can apply a constant biasing force onto an outer peripheral surface of a tape roll, as a result of which, the tape roll of favorable quality can be obtained.

In order to attain the above-described object, the present invention provides a tape winding apparatus comprising a winding shaft which winds up a tape and forms a tape roll, and a nozzle which sprays a gas toward an outer peripheral surface of the tape roll on an occasion of winding up the tape, wherein a recessed blowout part is formed at a tip end part of the nozzle, and in the blowout part, a plurality of slits extending in a width direction of the tape are disposed at predetermined spaces from each other in a traveling direction of the tape.

According to the present invention, the recessed blowout part is formed at the tip end part of the nozzle, and a plurality of slits are disposed at the blowout part. Therefore, the range where the sprayed gas presses the tape becomes wide, and the entire force which presses the tape becomes strong. Thereby, a constant biasing force can be applied to the outer peripheral surface of the tape roll, as a result of which, the tape roll of favorable quality can be obtained.

Namely, when the width of the slit is small as in the related art (the slit space g in FIG. 14), various troubles as already described occur when air pressure exerted on the tape roll varies. On the other hand, if the width of the slit is made wide, and air at the flow rate corresponding to this width is supplied, such a problem can be solved. However, when the width of the slit is made wide, the part which has negative pressure occurs in the slit width direction, and the tape is pulled at this portion, thus causing the problem of failure in winding up the tape.

On the other hand, the present invention solves all the above-described various problems and obtains a tape roll of favorable quality by providing the recessed blowout part at the tip end part of the nozzle, and providing a plurality of slits at this blowout part.

In the present invention, it is preferable that length of the blowout part in the width direction of the tape is 20% to 120% of the tape width. Besides, in the present invention, it is preferable that opening length of the slit is 20% to 120% of the tape width.

With the blowout part or slit of such length, a constant biasing force can be applied to the outer peripheral surface of the tape roll, as a result of which, the tape roll of favorable quality can be obtained.

Note that the slit means an oblong rectangular hole, the opening width of the slit indicates a short side of the rectangular hole, and the opening length of the slit indicates a long side of the rectangular hole.

It is preferable that the opening width of the slit is 0.05 to 0.3 mm.

In the present invention, it is preferable that a level difference of the blowout part is 0.05 mm to 3.0 mm. With such a blowout part, variation of air pressure exerted on the tape roll can be prevented, and occurrence of the problem of the tape being pulled by negative pressure can be prevented.

Note that with the level difference less than 0.05 mm, the force which presses the tape is insufficient, and with the level difference more than 3.0 mm, the effect of the blowout part cannot be obtained, both of which are not favorable.

In the present invention, it is preferable that two of the slits are provided, a side slit which connects both end parts of the slits is provided, and an annular slit is formed at a tip end of the nozzle by these slits. Such an annular slit is comparatively easy to produce, and the accuracy of the width of the slit can be easily obtained. Therefore, it is preferable in the effect obtained by the present invention.

Besides, in the present invention, it is preferable that the tip end of the nozzle is formed in a recessed shape to follow an outer peripheral surface of the tape roll. With such a shape, the clearance between the outer peripheral surface of the tape roll and the nozzle tip end can be made uniform in the tape traveling direction, and a constant biasing force can be applied to the outer peripheral surface of the tape roll.

Besides, in order to achieve the above described object, the present invention provides a tape winding apparatus comprising a winding shaft which winds up a tape and forms a tape roll, and a nozzle which sprays a gas toward an outer peripheral surface of the tape roll on an occasion of winding up the tape, wherein a recessed blowout part is formed at a tip end part of the nozzle, and in the blowout part, a plurality of slits extending in a traveling direction of the tape are disposed at predetermined spaces from each other in a width direction of the tape.

According to the present invention, the recessed blowout part is formed at the tip end part of the nozzle, and a plurality of slits are disposed at the blowout part. Therefore, the range where the sprayed gas presses the tape becomes wide, and the entire force which presses the tape becomes strong. Thereby, a constant biasing force can be applied to the outer peripheral surface of the tape roll, as a result of which, the tape roll of favorable quality can be obtained.

In the present invention, it is preferable that length of the blowout part in the width direction of the tape is 20% to 120% of the tape width. With the blowout part of such length, a constant biasing force can be applied to the outer peripheral surface of the tape roll, as a result of which, the tape roll of favorable quality can be obtained.

In the present invention, a range where a plurality of the slits are disposed in the width direction of the tape is 20% to 120% of the tape width. If a plurality of slits are disposed in the predetermined range in the width direction of the tape, the biasing force can be uniformly applied to the outer peripheral surface of the tape roll, as a result of which, the tape roll of favorable quality can be obtained.

Besides, in the present invention, it is preferable that a level difference of the blowout part is 0.05 mm to 3.0 mm. With such a blowout part, variation of air pressure exerted on the tape roll can be prevented, and occurrence of the problem of the tape being pulled by negative pressure can be prevented.

Besides, in the present invention, it is preferable that the tip end of the nozzle is formed in a recessed shape to follow an outer peripheral surface of the tape roll. With such a tip end shape, the clearance between the outer peripheral surface of the tape roll and the nozzle tip end can be made uniform in the tape traveling direction, and a constant biasing force can be applied to the outer peripheral surface of the tape roll.

As explained above, according to the present invention, the range where the sprayed gas presses the tape becomes wide, and the entire force which presses the tape becomes strong. Thereby, a constant biasing force can be applied to the outer peripheral surface of the tape roll, as a result of which, a tape roll of favorable quality can be obtained.

DETAILED DESCRIPTION OF THE PREFERRED EMBODIMENTS

Figure 1:
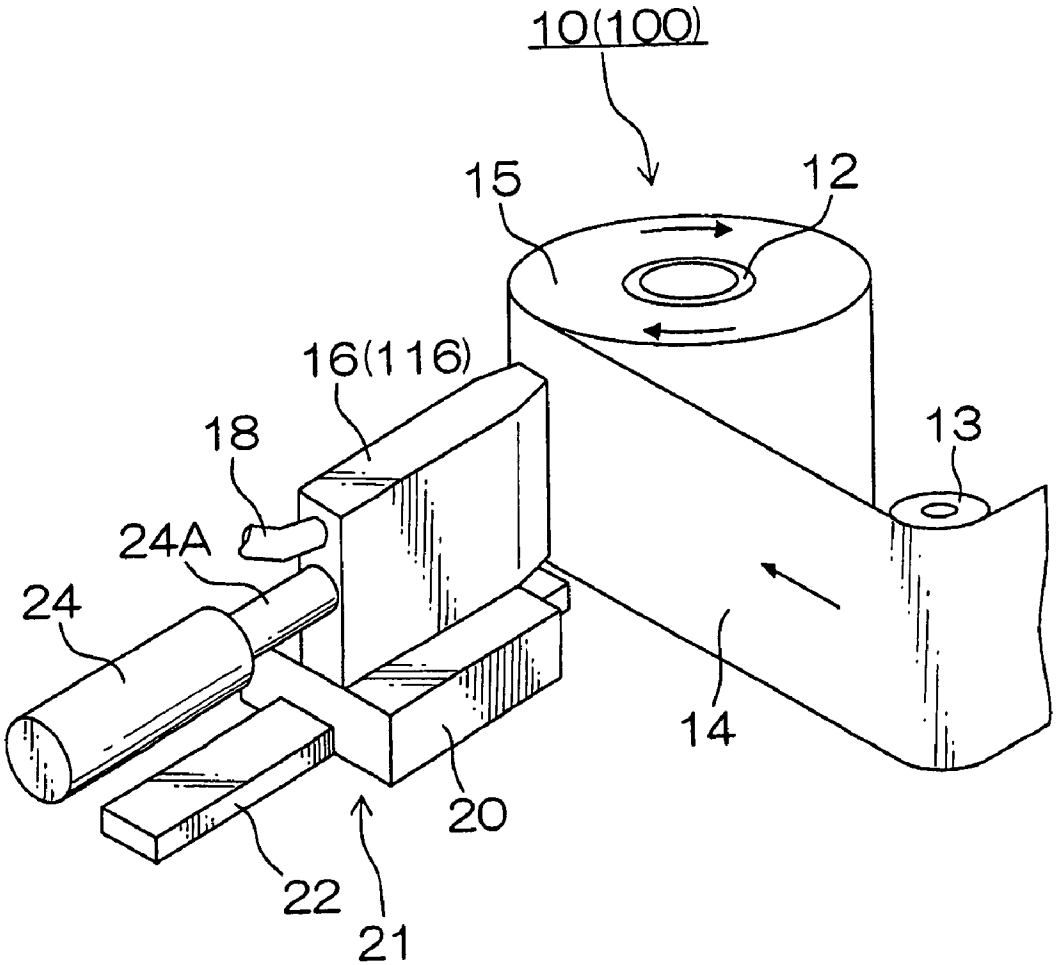
FIG. 1 is a perspective view showing a tape winding apparatus according to the present invention.
Figure 2:
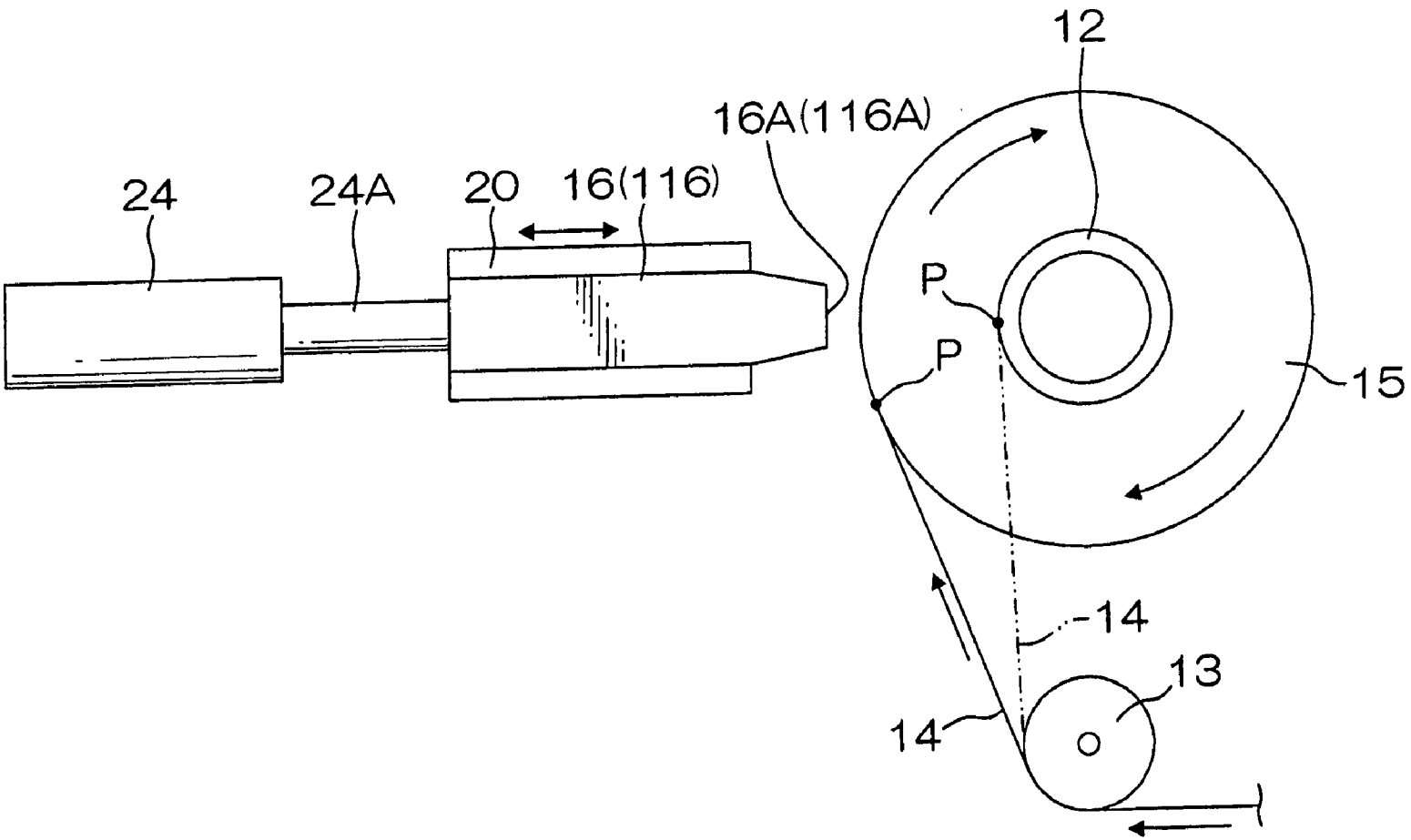
FIG. 2 is a plan view showing the tape winding apparatus according to the present invention.

A preferred embodiment (first embodiment) of a tape winding apparatus according to the present invention will be described in accordance with the attached drawings hereinafter. FIG. 1 is a perspective view showing a tape winding apparatus 10 according to the present invention, and FIG. 2 is a plan view of the same.

As shown in these drawings, the tape winding apparatus 10 has a reel (corresponds to a winding shaft) 12, and the reel 12 is connected to a motor not shown. The reel 12 rotates by driving the motor, and a tape 14 is wound up around the outer peripheral surface of the reel 12. Thereby, a tape roll 15 is formed. FIGS. 1 and 2 show the reel 12 without a flange, but the reel 12 is not limited to this, and a flanged reel provided with a flange at an end part at one side or flanges at end parts at both sides may be used.

Figure 3A:
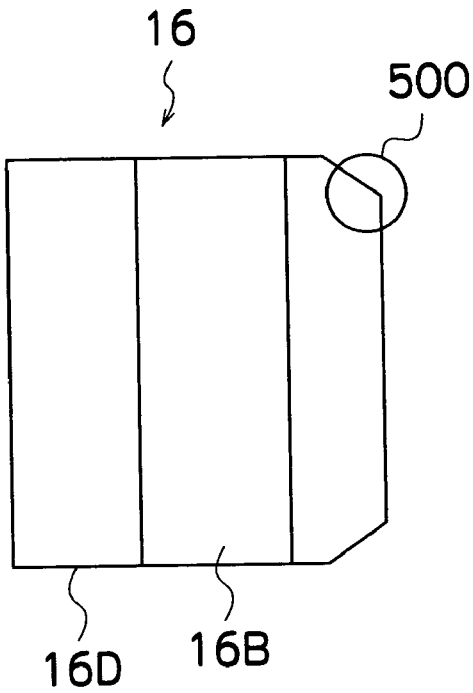
FIGS. 3A to 3C are views showing a tip end part of a nozzle.
Figure 3B:
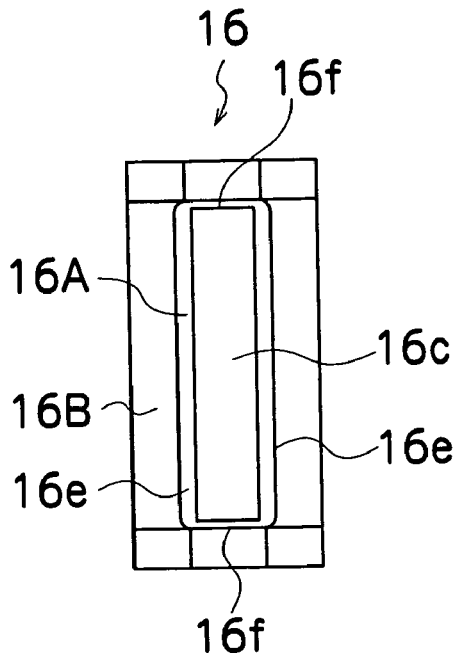
Figure 3C:
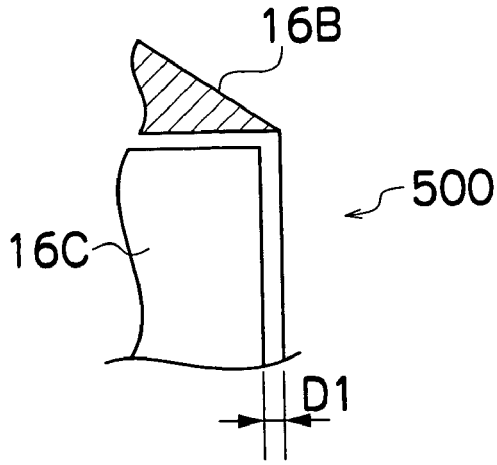

A nozzle 16 is disposed to oppose an outer peripheral surface of the tape roll 15. FIG. 3 is a view showing a tip end part of the nozzle 16. In FIGS. 3A, 3B and 3C, FIG. 3A is a front view, FIG. 3B is a right side view, and FIG. 3C is an enlarged sectional view of an inside of a circle in FIG. 3A.

As shown in the drawing, an annular slit 16A is formed at the tip end of the nozzle 16. The annular slit 16A is formed by slits 16*e* and 16*e* which extend in a width direction of the tape 14, and side slits 16*f* and 16*f* which connect both end parts of the slits 16*e* and 16*e*. Slit width (slit space) of this annular slit 16A is formed uniformly in the entire circumference. In order to facilitate understanding, the slit width is shown to be larger than the actual size.

In order to be able to form the annular slit 16A, the tip end part of the nozzle 16 is constructed by combining an outer frame 16B and an inner column 16C as shown in FIG. 3B. As shown in FIG. 3C, a tip end of the inner column 16C is recessed inside the slit by a predetermined amount D1 from the tip end of the outer frame 16B to be formed into a stepped shape. The value of the step D1 is preferably 0.05 to 3.0 mm as already described.

The nozzle 16 is constructed by combining a base part 16D having the inner column 16C at its tip end and the outer frame 16B as shown in FIG. 3A. Among them, a shape of the base part 16D is shown in FIGS. 4A and 4B, and a shape of the outer frame 16B is shown in FIGS. 5A to 5D, respectively.

Figure 4A:
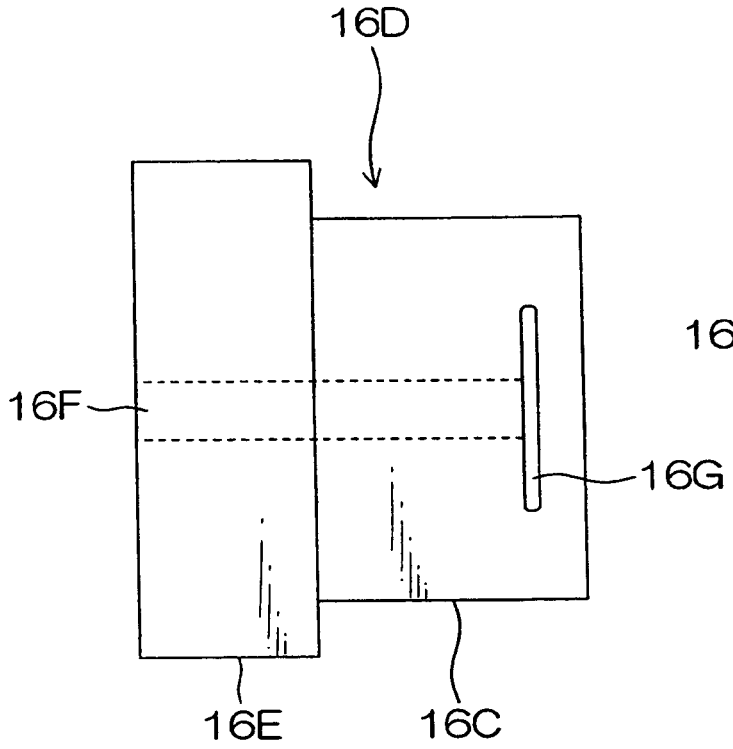
FIGS. 4A and 4B are views showing a base part of the nozzle.
Figure 4B:
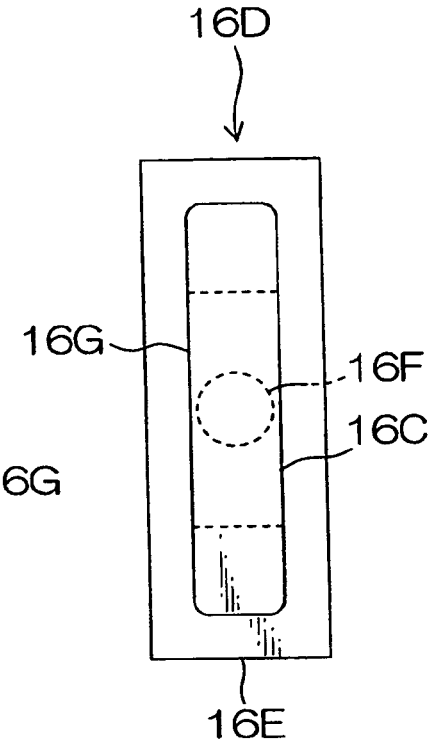

FIG. 4A is a front view of the base part 16D, and FIG. 4B is a right side view of the base part 16D. As shown in FIGS. 4A and 4B, the base part 16D is constructed by a base 16E with a rectangular section, and an inner column 16C with a smaller rectangular section than that of the base 16E, which is extensively provided at a tip end of the base 16E.

The base part 16D is provided with an air hole 16F, which provides communication with a rear end surface of the base 16E to a portion in the vicinity of a tip end part of the inner column 16C, and is provided with a long thorough-hole 16G which penetrates through the inner column 16C in a width direction (lateral direction in FIG. 4B).

According to this construction, air which is supplied to the air hole 16F from the rear end surface of the base 16E is blown out of both sides of the inner column 16C via the long through-hole 16G, fills inside the annular slit 16A (see FIG. 3B), and is evenly blown out from the tip end of the slit 16A. This makes it possible to apply a constant biasing force onto the outer peripheral surface of the tape roll, as a result of which, a tape roll of favorable quality can be obtained.

Figure 5A:
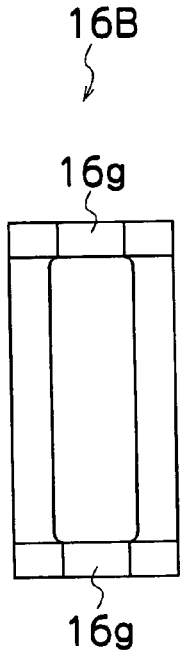
FIGS. 5A to 5D are views showing an outer frame of the nozzle.
Figure 5B:
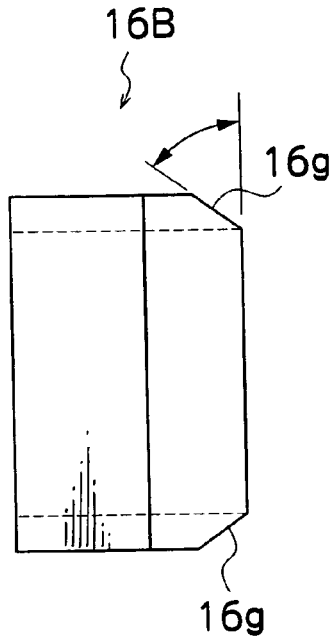
Figure 5C:
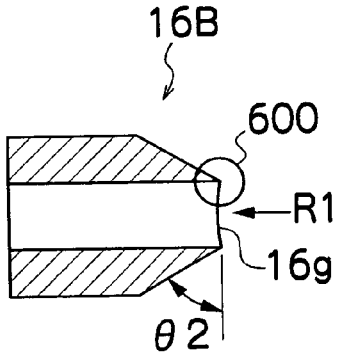
Figure 5D:
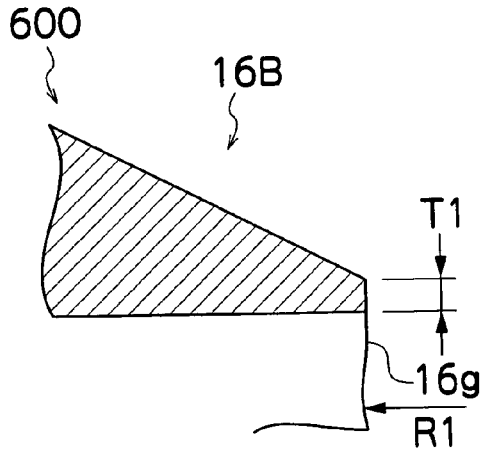

FIGS. 5A to 5D are views showing a shape of the outer frame 16B, FIG. 5A is a left side view, FIG. 5B is a front view, FIG. 5C is a sectional plan view, and FIG. 5D is an enlarged view of an inside of the circle in FIG. 5C. Namely, the outer frame 16B is an annular member, and the outer frame 16B and the inner column 16C placed inside it construct the annular slit 16A (see FIG. 3B).

As shown in FIG. 5B, a tip end part (in front view) of the outer frame 16B is formed into a predetermined tapered shape, and is formed at an angle of θ1 with respect to a blow-out surface at the tip end of the nozzle 16. Besides, as shown in FIG. 5C, the tip end part (in plan view) of the outer frame 16B is formed into a predetermined tapered shape, and is formed at an angle of θ2 with respect to the blow-out surface of the tip end of the nozzle 16.

The reason why the tip end part is formed into such a tapered shape is for prevention of occurrence of a trouble caused by wrapping up air. The angles θ1 and θ2 can be set at, for example, 60 degrees.

Besides, for the same object, a tip end part of the outer frame 16B (in plan view) is formed into a knife edge shape so that a wall thickness T1 becomes the minimum thickness as shown in FIG. 5D. The thickness T1 can be formed at 0.05 mm, for example.

Further, as shown in FIGS. 5C and 5D, tip ends of upper and lower short sides 16*g* and 16*g* of the outer frame 16B are formed into a recessed R-shape to follow the outer peripheral surface of the tape roll 15. In the case of the shape of such an outer frame 16B, a clearance between the outer peripheral surface of the tape roll 15 and the tip end of the nozzle 16 can be made even in the tape traveling direction, and a constant biasing force can be applied onto the outer peripheral surface of the tape roll 15.

When the tape 14 is wound up around the outer peripheral surface of the reel 12 with the outer diameter of 44 mm, and the tape roll 15 of a product size is of the outer diameter of 90 mm, R1 of the tip end parts of the upper and lower short sides of the outer frame 16B is preferably set at 22 mm (radius of the reel 12) to 45 mm (radius of the tape roll 15 of the product size), and it can be set at, for example, 25 mm.

The same effect can be obtained even when the shapes of the tip end parts of the upper and lower short sides of the outer frame 16B are in various kinds of shapes other than the arc shape (R-shape), for example, a hyperbolic shape, an elliptic shape, a parabolic shape, a polyline shape and the like.

The size of the slit 16A, which is formed by the above base 16E and the outer frame 16B as shown in FIG. 3B, in the width direction of the tape 14 (up and down direction in the drawing) is formed in accordance with the dimension of the tape 14 as shown in FIG. 1 already described. For example, when the width of the tape 14 is 12.7 mm (½ inches), the size (opening length) of the slit 16A in the width direction of the tape 14 (the up and down direction in the drawing) is preferably 20 to 120% (2.5 to 15.2 mm) of the tape width, and more preferably, 50 to 105% (6.4 to 13.3 mm) of the tape width.

The space between the long sides of the slit 16A in the tape traveling direction is formed in accordance with the dimension of the tape roll 15. When the space between the long sides of the slit 16A in the tape traveling direction is too large, a biasing force applied onto the outer peripheral surface of the tape roll 15 becomes insufficient, and when the space between the long sides of the slit 16A in the tape traveling direction is too small, there is no difference from a single slit, and the effect of the present invention is not obtained.

As already described, the slit width of the slit 16A is set at 0.05 to 0.3 mm.

As shown in FIG. 1, the hose 18 is connected to the rear end side of the nozzle 16. The hose 18 is connected to a fluid supply source (air supply system) in FIG. 6, and a fluid is supplied to the hose 18 from this fluid supply source.

Figure 6:
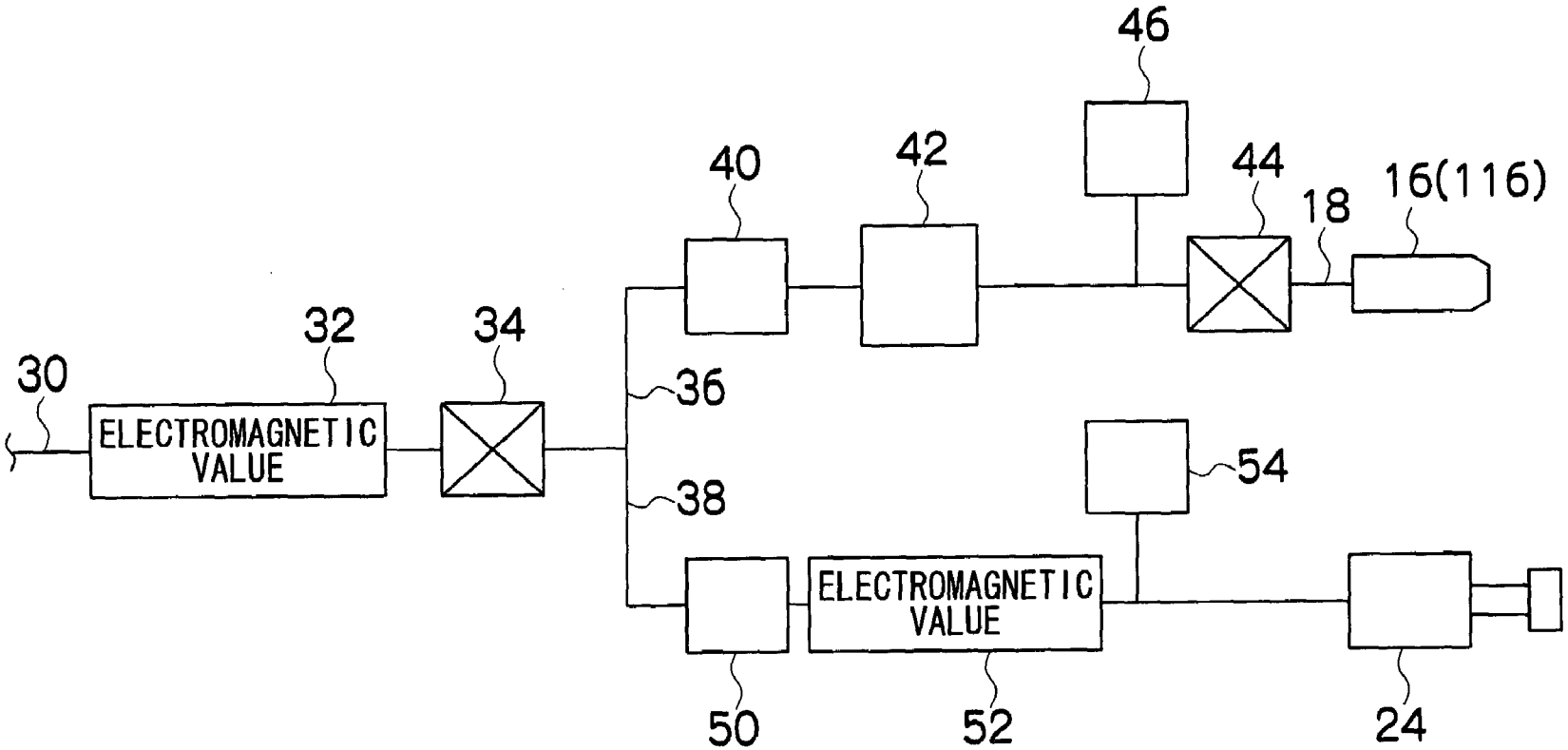
FIG. 6 is a diagram showing an air supply system of the tape winding apparatus.

FIG. 6 is a diagram showing an air supply system of the tape winding apparatus 10. A pipe 30 from the air supply source is provided with an electromagnetic valve 32 and an air filter 34 in the sequence from an upstream side. At a downstream side of the air filter 34, the pipe 30 is divided into a pipe 36 of a nozzle system and a pipe 38 of a cylinder system.

In the pipe 36 of the nozzle system, a regulator 40, a flowmeter 42, an air filter 44 are provided in the sequence from the upstream side, so that air is supplied to the nozzle 16 via the hose 18. A pressure sensor 46 is connected to the pipe 36 at the downstream side of the flowmeter 42, so that the pressure inside the pipe 36 can be detected.

In the pipe 38 of the cylinder system, a regulator 50 and an electromagnetic valve 52 are provided in the sequence from the upstream side, so that air is supplied to an air cylinder 24. A pressure sensor 54 is connected to the pipe 38 at the downstream side of the electromagnetic valve 52, so that the pressure inside the pipe 38 can be detected.

The specifications and functions of these piping members are the same as those for general use, and therefore, the detailed explanation will be omitted.

As the flowmeter 42, a thermal gas flowmeter is used. Since the thermal gas flowmeter is favorable in responsiveness (for example, 1 msec.), wide in the measurement range (for example, 300:1), and small in the minimum flow speed (for example, 1 cm/sec.), and the measured value can be taken out as an electrical signal, the thermal gas flowmeter is suitable for the air supply system of the tape winding apparatus 10. As such a thermal gas flowmeter, for example, the one made by, for example, Yamatake Corporation (trade name: Mass Flowmeter) can be used.

In the air supply system of the tape winding apparatus 10, the electromagnetic valve 32, the regulator 40, the flowmeter 42, the pressure sensor 46, the regulator 50, the electromagnetic valve 52 and the pressure sensor 54 are respectively connected to a control device (PC or the like) not shown. Thereby, the measured values of the flowmeter 42, the pressure sensor 46 and the pressure sensor 54 are transmitted to the control device, so that the electromagnetic valve 32, the regulator 40, the regulator 50 and the electromagnetic valve 52 are controlled by the control device.

By the construction explained according to FIGS. 1 to 6, when a fluid (air) is supplied to the nozzle 16 from the hose 18, the fluid is blown out toward the outer peripheral surface of the tape roll 15 from the annular slit 16A which is the opening of the nozzle 16. The flow rate of the fluid in this case is controlled to be 5 to 50 (nL/mm$^2$/min), for example. Note that the kind of the fluid is not especially limited, and air, an inert gas (for example, a nitrogen gas) and the like can be used.

Figure 7:
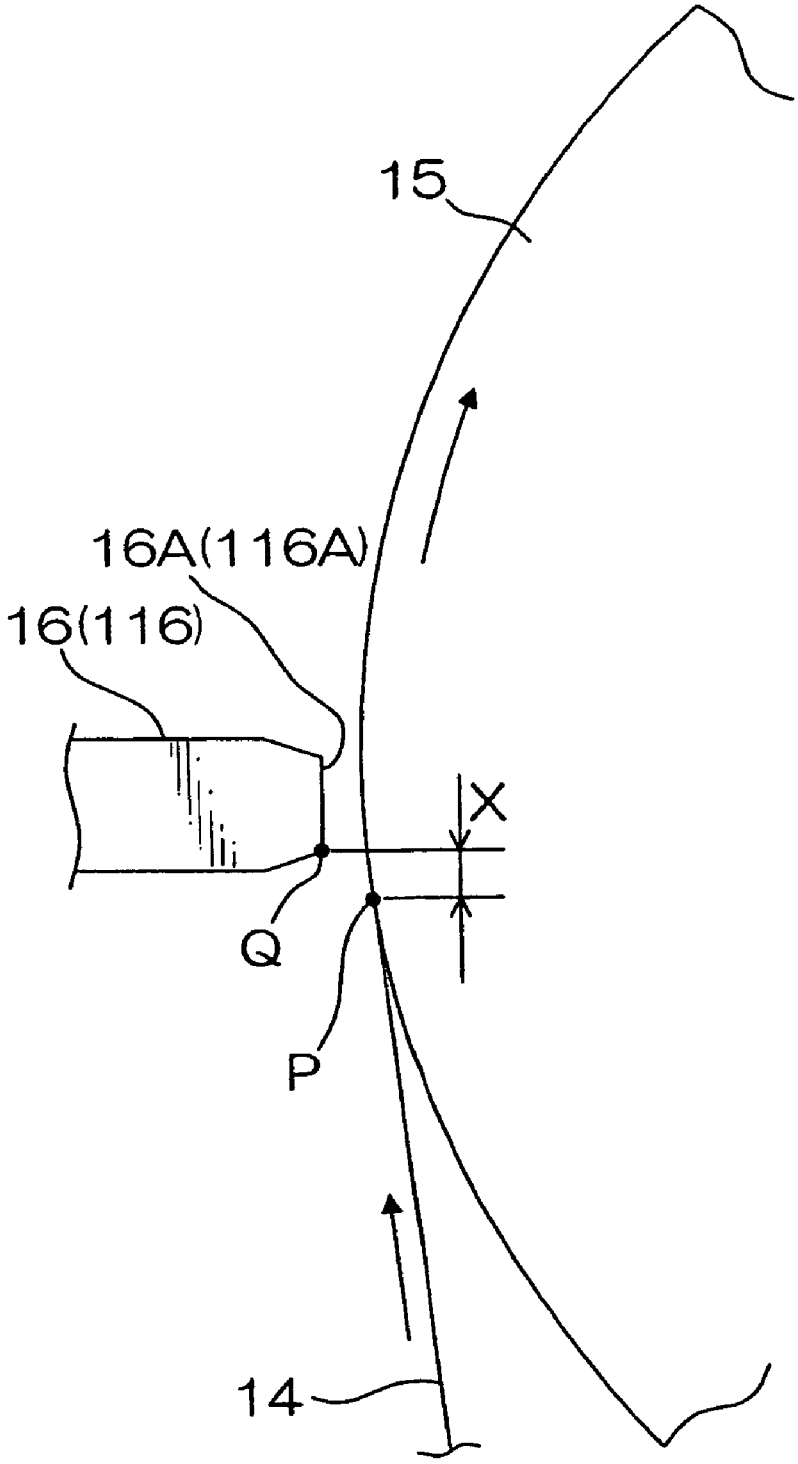
FIG. 7 is an explanatory view explaining a spraying position of air.

FIG. 7 is an explanatory view for explaining the spraying position of air to the tape roll 15. When the point at which the tape 14 contacts the tape roll 15 is set as a contact point P, the spraying position of air needs to be at a downstream side in the winding direction from the contact point P. This is because the effect of adjusting winding tightness of the tape roll 15 cannot be obtained even if air is sprayed to the tape 14 at the upstream side from the contact point P.

As shown in FIGS. 1 and 2, the tape 14 is wound around the guide roller 13 and wound up by the tape roll 15. The guide roller 13 is fixed to a skeleton (not shown) of the tape winding apparatus 10. Therefore, there is the problem that as the winding diameter of the tape roll 15 increases, the position of the contact point P changes in a circumferential direction, and positional relationship between the contact point P and the spraying position of air changes. Thus, when the winding diameter of the tape roll 15 is the smallest (see the two-dot chain line in FIG. 2), the guide roller 13 and the nozzle 16 are positioned and mounted so that the contact point P and the spraying position of air satisfy the above-described relationship. Thereby, when the winding diameter of the tape roll 15 increases, the contact point P moves to the upstream side in the winding direction, and therefore, the spraying position of air is always disposed at the downstream side from the contact point P.

Figure 8:
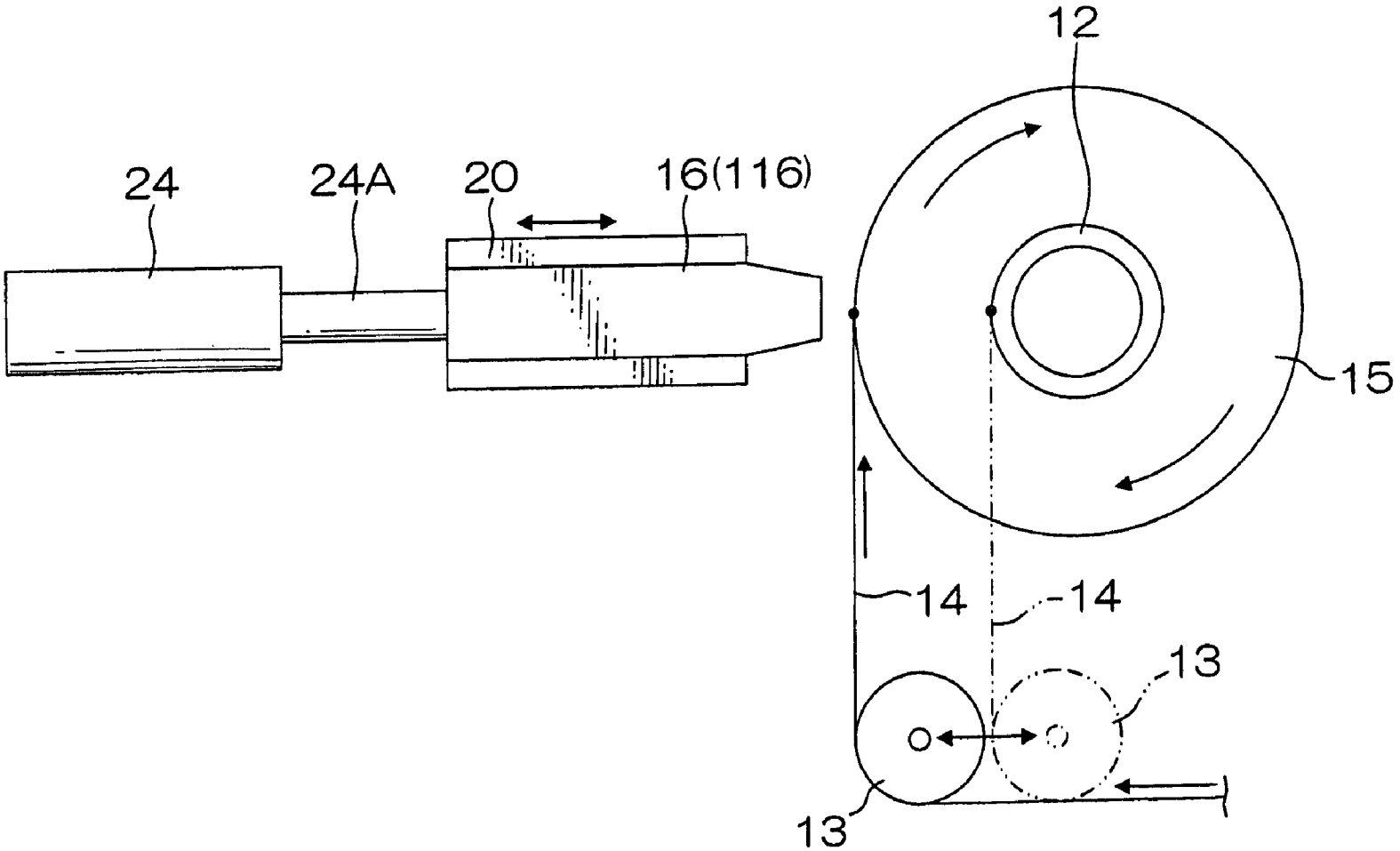
FIG. 8 is a plan view of the tape winding apparatus using a different guide roller from FIG. 2.

As shown in FIG. 8, the guide roller 13 may be moved with an increase of the winding diameter of the tape roll 15. In this case, the guide roller 13 may be fixed to a slider 20 of a linear guide 21 which will be described later. Thereby, when the winding diameter of the tape roll 15 increases, the nozzle 16 moves to retreat from the reel 12, and the guide roller 13 also moves with this. Accordingly, the relationship of the contact point P and the spraying position of air is kept substantially constant irrespective of the winding diameter of the tape roll 15. Namely, air which is sprayed from the nozzle 16 is always sprayed to the downstream side of the contact point P.

The nozzle 16 disposed as described above is fixed on the slider 20 which constructs the linear guide 21. The slider 20 is slidably supported on a rail 22, and the rail 22 is disposed in the diameter direction of the reel 12 (namely, in the orthogonal direction to the surface in contact with the outer peripheral surface of the tape roll 15). Thereby, the nozzle 16 is supported to be able to advance and retreat with respect to the outer peripheral surface of the tape roll 15.

The air cylinder 24 is provided behind the nozzle 16. The air cylinder 24 is fixed to the skeleton of an apparatus body not shown. A rod 24A of the air cylinder 24 extends and contracts in the diameter direction of the reel 12, and the nozzle 16 is biased to the tape roll 15 side with a constant biasing force, for example, a biasing force of 0.49 N to 10 N (=50 gf to 1.02 kgf) by a tip end of the rod 24A. When the nozzle 16 is biased toward the tape roll 15 from behind, the nozzle 16 approaches the tape roll 15, and automatically moves to a certain position, namely, a position where a repulsive force of an air layer which is formed in a clearance between the nozzle 16 and the tape roll 15 and the biasing force by the air cylinder 24 balance with each other, and stops.

For example, when a distance (clearance) between the nozzle 16 and the outer peripheral surface of the tape roll 15 is small, the flow of the air flowing out into the clearance decreases, thus increasing the pressure of the air layer, and making the repulsive force large. Therefore, the repulsive force becomes larger than the biasing force of the air cylinder 24, and therefore, the nozzle 16 retreats to the position where both of them balance with each other.

On the other hand, when the distance (clearance) between the nozzle 16 and the outer peripheral surface of the tape roll 15 is large, the flow of air flowing out into the clearance increases, thus decreasing the pressure of the air layer and making the repulsive force small. Therefore, the repulsive force becomes smaller than the biasing force of the air cylinder 24, and therefore, the nozzle 16 is moved forward by the biasing force of the air cylinder 24 and stops at the position where both of them balance with each other.

Since the nozzle 16 is automatically adjusted to the position where the pressure of the air layer and the biasing force of the air cylinder 24 balance with each other as described above, the nozzle 16 is always kept at a constant distance with respect to the outer peripheral surface of the tape roll 15. Note that the air cylinder 24 is not limited to the piston type, but a bellows type of biasing device which does not generate a frictional force may be used on the occasion of moving the rod 24A.

Next, an operation of the tape winding apparatus 10 configured as described above will be described.

In the tape winding apparatus 10, the tape 14 is wound up around the reel 12 by rotating the reel 12, and the tape roll 15 is formed. On this occasion, by spraying air to the outer peripheral surface of the tape roll 15 from the nozzle 16, the tape 14 is brought into close contact with the outer peripheral surface of the tape roll 15, and air is prevented from being wrapped in.

On the occasion of winding up the tape, the nozzle 16 is biased toward the outer peripheral surface of the tape roll 15 by a constant biasing force by the air cylinder 24. The nozzle 16 receives a repulsive force by the air layer at the tip end of the nozzle 16 by spraying air from the nozzle 16. Accordingly, the nozzle 16 automatically moves to the position where the repulsive force by the air layer at the tip end of the nozzle 16 and the biasing force by the air cylinder 24 at the rear end of the nozzle 16 balance with each other, and stops.

As a result, since the distance between the nozzle 16 and the outer peripheral surface of the tape roll 15 is kept constant, a constant pressing force is always applied to the outer peripheral surface of the tape roll 15, and the tape 14 can be wound up with suitable winding tightness.

According to the tape winding apparatus 10 of this embodiment as described above, the nozzle 16 is slidably supported and is biased to the tape roll 15 side with a constant biasing force. Therefore, the nozzle 16 is always kept at a constant distance from the outer peripheral surface of the tape roll 15. Since the constant pressing force is applied to the outer peripheral surface of the tape roll 15 by air blown out from the nozzle 16, the tape 14 is wound up with suitable winding tightness.

Especially according to the construction in which the blowout part at the tip end of the nozzle 16 is formed to be the annular slit 16A including two slits, which extend in the width direction of the tape 14, the range where the sprayed gas presses the tape 14 becomes large, and the entire force pressing the tape 14 becomes strong. Thereby, a constant biasing force can be applied to the outer peripheral surface of the tape roll 15, as a result of which, the tape roll 15 of favorable quality can be obtained.

According to the tape winding apparatus 10, the nozzle 16 is supported to be able to advance and retreat with respect to the outer peripheral surface of the tape roll 15, and therefore, when the nozzle 16 comes too close to the outer peripheral surface of the tape roll 15, the nozzle 16 moves in the direction to retreat from the outer peripheral surface of the tape roll 15 as a result that the repulsive force of the sprayed air layer increases. Accordingly, the nozzle 16 can be prevented from contacting the outer peripheral surface of the tape roll 15.

The first embodiment of the tape winding apparatus according to the present invention is explained above, but the present invention is not limited to the above-described embodiment, and various kinds of modes can be adopted.

For example, in this embodiment, the blowout part at the tip end of the nozzle 16 is made the annular slit 16A, but the other modes than this may be adopted. Namely, when the blowout part at the tip end of the nozzle 16 is formed by a plurality of slits (not limited to two), which extend in the width direction of the tape 14, the effect of the present invention is obtained. Besides, if the opening width of the slit is not formed to be even over the entire length of the opening length of the slit as in this embodiment, and has a disconnected portion, it can be said to be in the range equivalent to the present invention as long as the same effect as the present invention is obtained.

Figure 9A:
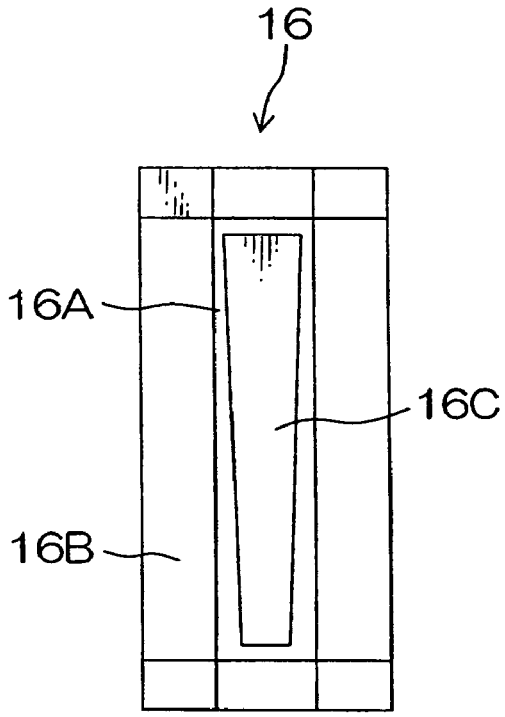
FIGS. 9A and 9B are views showing another mode of the tip end part of the nozzle.
Figure 9B:
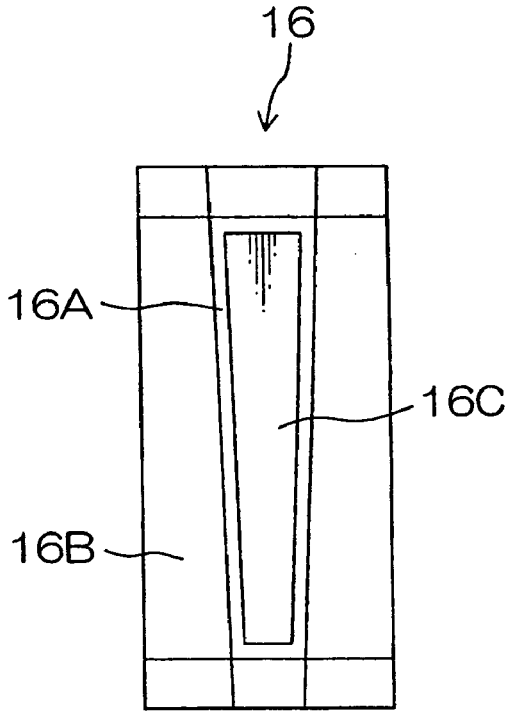

In this embodiment, as shown in FIG. 3B, the slit width (slit space) of the annular slit 16A of the nozzle 16 is formed to be uniform in the entire circumference, but the other modes than this can be adopted. FIGS. 9A and 9B are views showing another mode of the tip end part of the nozzle. Of them, FIG. 9A shows the one in the shape in which the slit width (slit space) linearly increases toward the lower part from the upper part. On the other hand, FIG. 9B shows the one in which the slit width (slit space) is uniform in the entire circumference, but the annular slit shape in this embodiment is in the trapezoidal shape.

By adopting the nozzle of such a mode, the effect which will be described as follows is obtained. Namely, many magnetic tapes in recent years are thin and smooth, and are difficult to wind up as compared with the conventional magnetic tape. Therefore, it is proposed to make a winding shape favorable by winding up a magnetic tape by moving it to one side of the winding shaft when the magnetic tape is wound up, but there are few suitable devices as the concrete device.

On the other hand, by adopting the tip end part of the nozzle as shown in FIGS. 9A and 9B, the force for pressing the tape can be changed in the width direction of the tape. Therefore, on the occasion of winding up the tape, the tape can be wound up by reliably moving the tape to one side of the winding shaft, whereby the tape roll with a favorable winding shape can be obtained.

In this embodiment, the method of slidably supporting the nozzle 16 and biasing it with a constant biasing force is adopted, but the method of fixing the nozzle 16 at a predetermined position can be adopted. Namely, if the entire force pressing the tape 14 can be made strong according to the construction in which the blowout part at the tip end of the nozzle 16 is formed to be the annular slit 16A including two slits, which extend in the width direction of the tape 14, the effect of the present invention can be obtained.

Further, in this embodiment, the air cylinder 24 is used as the device which biases the nozzle 16 with a constant biasing force, but the biasing device is not limited to this, and a hydraulic cylinder may be used, or a biasing device which biases the nozzle 16 by utilizing gravity, a magnetic force and the like may be used.

The tape winding apparatus according to the present invention is especially suitable as a tape winding apparatus which winds up a magnetic tape. As for the magnetic tape, it is necessary to align the edge of the tape at the time of winding, and reliably prevent wrapping up air in the tape which is wound up, and by using the tape winding apparatus of the present invention, the magnetic tape can be wound up with suitable winding tightness, and therefore, the magnetic tape can be neatly wound up with the edge aligned without wrapping up air.

Next, another embodiment (second embodiment) of the tape winding apparatus according to the present invention will be described. Since the apparatus is an apparatus with substantially the same construction as the tape winding apparatus 10 in the already-described FIG. 1 (perspective view) and FIG. 2 (plan view), the redundant explanation will be omitted. In this case, the tape winding apparatus 10 is described as a tape winding apparatus 100, and the nozzle 16 as a nozzle 116.

Figure 10A:
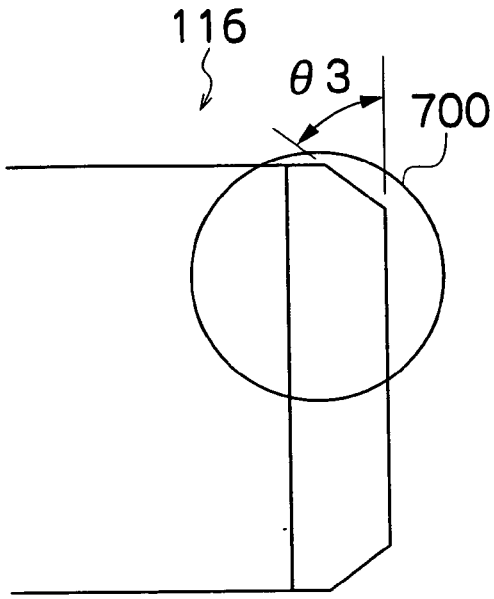
FIGS. 10A to 10C are views showing the tip end part of the nozzle.
Figure 10B:
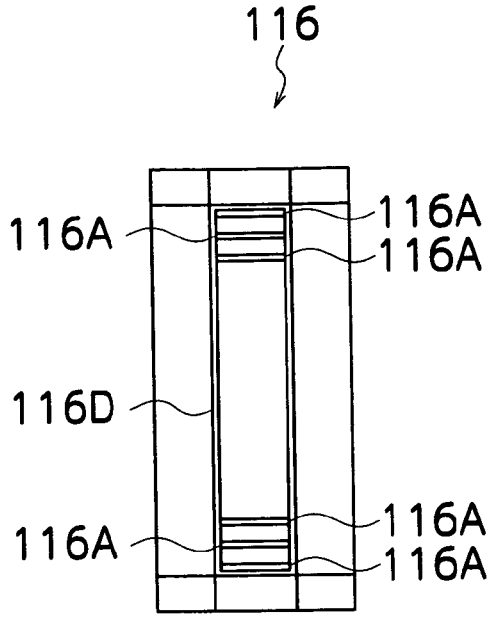
Figure 10C:
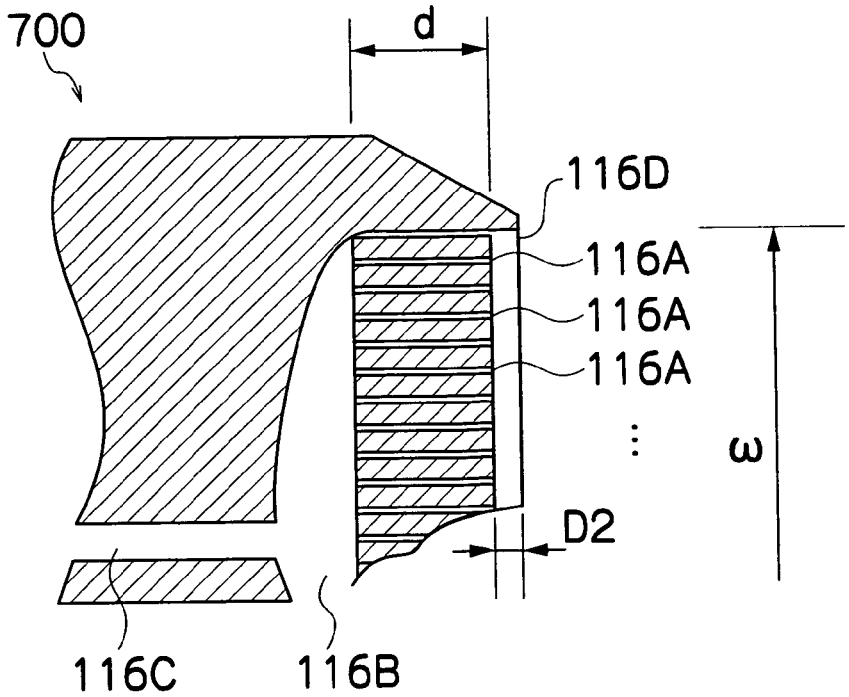

The nozzle 116 is disposed to oppose the outer peripheral surface of the tape roll 15. FIGS. 10A, 10B and 10C are views showing tip end part of the nozzle 116. Among them, FIG. 10A is a front view, FIG. 10B is a right side view, and FIG. 10C is an enlarged sectional view of the inside of the circle in FIG. 10A.

As shown in these drawings, a plurality of slits 116A, 116A, which extend in the traveling direction of the tape are formed at the tip end of the nozzle 116. Slit opening width (slit space) of the slit 116A is formed to be 0.05 to 0.3 mm. To facilitate understanding, the slit width is shown to be larger than the actual width.

The slits 116A, 116A are disposed at predetermined spaces from each other over the width direction of the tape (up and down direction in the drawing). The area length (length w in FIG. 10C) in the up and down direction of the drawing in which the slits 116A, 116A are disposed is formed in accordance with the dimension of the tape 14 as shown in the already-described FIG. 1.

When the width of the tape 14 is, for example, 12.7 mm (½ inches), the area length w in the width direction (the up and down direction of the drawing) of the tape 14 where the slits 116A, 116A are disposed is preferably 20 to 120% (2.5 to 15.2 mm) of the tape width, and is more preferably 50 to 105% (6.4 to 13.3 mm) of the tape width.

The opening length of each of the slits 116A, 116A is formed in accordance with the dimension of the tape roll 15. When the opening length of each of the slits 116A, 116A is too small, the biasing force applied to the outer peripheral surface of the tape roll 15 becomes insufficient, and the effect of the present invention is not obtained.

A depth d of the slits 116A, 116A as shown in FIG. 10C can be set at, for example, 1 to 5 mm. As a forming method of such slits 116A, 116A, various known working methods such as electro-discharge machining, and laser machining can be adopted.

A method for forming slits 116A, 116A shown in the drawing by overlaying a plurality of etching sheets (photo-etched templates) in which holes in the shapes of the slits 116A, 116A are formed in a thin (for example, 0.2 mm thick) metal plate can be adopted.

As shown in FIG. 10C, a flow passage 116B which is an air flow space communicating with all the slits 116A, 116A is formed in rear surfaces of the slits 116A, 116A. The size in the up and down direction of the flow passage 116B is formed to be gradually smaller from the length w at the right side to be a dimension of an air flow hole 116C at the left side. Note that the air flow hole 116C is a hole which communicates with the flow passage 116B from the rear end surface of the nozzle 116.

According to the above construction, air supplied to the air flow hole 116C from the rear end surface of the nozzle 116 is blown out to the flow passage 116B via the air flow hole 116C, filled inside the flow passage 116B, and is uniformly blown out from the tip end of each of the slits 116A, 116A. Thereby, a constant biasing force can be applied to the outer peripheral surface of the tape roll, as a result of which, the tape roll of favorable quality can be obtained.

As shown in FIGS. 10B and 10C, a frame-shaped projected part 116D is formed to surround an area where the slits 116A, 116A are disposed in the tip end of the nozzle 116. A recessed blowout part is constructed by the projected part 116D. A level difference D2 of the projected part 116D shown in FIG. 10C is preferably set at 0.05 to 3.0 mm as already described.

Figure 11A:
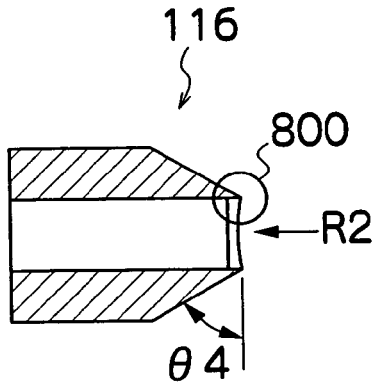
FIGS. 11A and 11B are sectional views showing the tip end part of the nozzle.
Figure 11B:
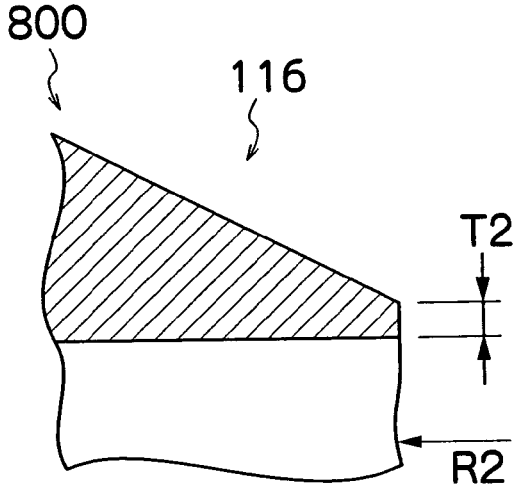

FIGS. 11A and 11B are sectional views showing a tip end part of the nozzle 116. Among them, FIG. 11A is a sectional plan view, and FIG. 11B is an enlarged view of an inside of the circle in FIG. 11A. As shown in FIG. 11A, the tip end part of the nozzle 116 (in plan view) is formed into a predetermined taper shape, and is formed at an angle of θ4 with respect to the blowout surface of the tip end of the nozzle 116. As shown in FIG. 10A, the tip end part (in front view) of the nozzle 116 is formed into a predetermined tapered shape, and is formed at an angle of θ3 with respect to the blowout surface of the tip end of the nozzle 116.

The reason why the tip end part is formed into such a taper shape is for prevention of occurrence of a trouble by wrapping up air. The angles θ3 and θ4 can be set at, for example, 60 degrees.

Besides, for the same purpose, the tip end part of the nozzle 116 (in plan view) is formed into a knife edge shape so that the wall thickness T2 becomes the minimum thickness as shown in FIG. 11B. This wall thickness T2 can be formed to be, for example, 0.05 mm.

Further, as shown in FIGS. 11A and 11B, the tip end of the nozzle 116 is formed into a recessed R shape to follow the outer peripheral surface of the tape roll 15. In the case of such a tip end shape of the nozzle 116, the clearance between the outer peripheral surface of the tape roll 15 and the tip end of the nozzle 116 can be made uniform in the tape traveling direction, and a constant biasing force can be applied to the outer peripheral surface of the tape roll 15.

When the tape 14 is wound up around the outer peripheral surface of the reel 12 with the outer diameter of 44 mm, and the tape roll 15 of a product size is of the outer diameter of 90 mm, R2 of the tip end part of the nozzle 116 is preferably set at 22 mm (radius of the reel 12) to 45 mm (radius of the tape roll 15 of the product size), and it can be set at, for example, 25 mm.

The same effect can be obtained even when the shape of the tip end part of the nozzle 116 is in various kinds of shapes other than the arc shape (R-shape), for example, a hyperbolic shape, an elliptic shape, a parabolic shape, a polyline shape and the like.

As shown in FIG. 1, the hose 18 is connected to the rear end side of the nozzle 116. The hose 18 is connected to a fluid supply source (air supply system) in FIG. 6 which is already described, and a fluid is supplied to the hose 18 from this fluid supply source.

By the construction explained according to FIGS. 1, 2, 6, 10 and 11, when a fluid (air) is supplied to the nozzle 116 from the hose 18, the fluid is blown out toward the outer peripheral surface of the tape roll 15 from a plurality of slits 116A, 116A which are openings of the nozzle 116. The flow rate of the fluid in this case is controlled to be 5 to 50 (nL/mm2/min), for example. Note that the kind of fluid is not especially limited, and air, an inert gas (for example, a nitrogen gas) and the like can be used.

Note that the construction of the spraying position of air with respect to the tape roll 15 described according to FIG. 7, the construction of the guide roller 13 described according to FIGS. 2 and 8, and the constructions of the slider 20, the linear guide 21, the rail 22, the air cylinder 24 and the like which are described according to FIGS. 1 and 2 in the first embodiment are the same, and therefore, the explanation thereof will be omitted.

The nozzle 116 is biased to the tape roll 15 side with a constant biasing force of, for example, 0.49 N to 10 N (=50 gf to 1.02 kgf) by a tip end of the rod 24A shown in FIGS. 1 and 2. When the nozzle 116 is biased toward the tape roll 15 from behind, the nozzle 116 approaches the tape roll 15, automatically moves to a certain position, namely, a position where a repulsive force of an air layer which is formed in a clearance between the nozzle 116 and the tape roll 15 and the biasing force by the air cylinder 24 balance with each other, and stops.

For example, when a distance (clearance) between the nozzle 116 and the outer peripheral surface of the tape roll 15 is small, the flow rate of the air flowing out into the clearance decreases, thus increasing the pressure of the air layer, and making repulsive force large. Therefore, the repulsive force becomes larger than the biasing force of the air cylinder 24, and therefore, the nozzle 116 retreats to the place where both of them balance with each other.

On the other hand, when the distance (clearance) between the nozzle 116 and the outer peripheral surface of the tape roll 15 is large, the flow rate of air flowing out into the clearance increases, thus decreasing the pressure of the air layer and making the repulsive force small. Therefore, the repulsive force becomes smaller than the biasing force of the air cylinder 24, and therefore, the nozzle 116 is moved forward by the biasing force of the air cylinder 24 and stops at the position where both of them balance with each other.

Since the nozzle 116 is automatically adjusted to the position where the pressure of the air layer and the biasing force of the air cylinder 24 balance with each other as described above, the nozzle 116 is always kept at a constant distance with respect to the outer peripheral surface of the tape roll 15.

Next, an operation of the tape winding apparatus 100 configured as described above will be described.

In the tape winding apparatus 100, the tape 14 is wound up around the reel 12 by rotating the reel 12, and the tape roll 15 is formed. On this occasion, by spraying air to the outer peripheral surface of the tape roll 15 from the nozzle 116, the tape 14 is brought into close contact with the outer peripheral surface of the tape roll 15, and air is prevented from being wrapped in.

On the occasion of winding up the tape, the nozzle 116 is biased toward the outer peripheral surface of the tape roll 15 by a constant biasing force by the air cylinder 24. The nozzle 116 receives a repulsive force by the air layer at the tip end of the nozzle 116 by blowing out air from the nozzle 116. Accordingly, the nozzle 116 automatically moves to the position where the repulsive force by the air layer at the tip end of the nozzle 116 and the biasing force by the air cylinder 24 at the rear end of the nozzle 116 balance with each other, and stops.

As a result, since the distance between the nozzle 116 and the outer peripheral surface of the tape roll 15 is kept constant, a constant pressing force is always applied to the outer peripheral surface of the tape roll 15, and the tape 14 can be wound up with suitable winding tightness.

According to the tape winding apparatus 100 of this embodiment as described above, the nozzle 116 is slidably supported and is biased to the tape roll 15 side with a constant biasing force. Therefore, the nozzle 116 is always kept at a constant distance form the outer peripheral surface of the tape roll 15. Since the constant pressing force is applied to the outer peripheral surface of the tape roll 15 by air blown out from the nozzle 116, the tape 14 is wound up with suitable winding tightness.

Especially according to the construction in which the blowout part at the tip end of the nozzle 116 is formed to be a plurality of slits 116A which extend in the width direction of the tape 14, the range where the sprayed air presses the tape 14 becomes large, and the entire force pressing the tape 14 becomes strong. Thereby, a constant biasing force can be applied to the outer peripheral surface of the tape roll 15, as a result of which, the tape roll 15 of favorable quality can be obtained.

According to the tape winding apparatus 100, the nozzle 116 is supported to be able to advance and retreat with respect to the outer peripheral surface of the tape roll 15, and therefore, when the nozzle 116 comes too close to the outer peripheral surface of the tape roll 15, the nozzle 116 moves in the direction to retreat from the outer peripheral surface of the tape roll 15 as a result that the repulsive force of the sprayed air layer increases. Accordingly, the nozzle 116 can be prevented from contacting the outer peripheral surface of the tape roll 15.

The second embodiment of the tape winding apparatus according to the present invention is explained above, but the present invention is not limited to the above-described embodiment, and various kinds of modes can be adopted.

For example, in this embodiment, the blowout part at the tip end of the nozzle 116 is made a plurality of slits 116A, 116A with uniform opening lengths extending in the traveling direction of the tape 14 and uniform opening widths as shown in FIG. 10B, but the other mode than this may be adopted. Namely, when the blowout part at the tip end of the nozzle 116 is formed by a plurality of slits (two or more) which extend in the traveling direction of the tape 14, the effect of the present invention is obtained.

Various modes of 1) changing the slit opening width (slit space), 2) changing the space (pitch) between the slits 116A, 116A, 3) changing the slit opening length, and 4) combining two or more of the above-described 1) to 3) can be adopted, depending on the position where the slit 116A is provided.

Figure 12C:
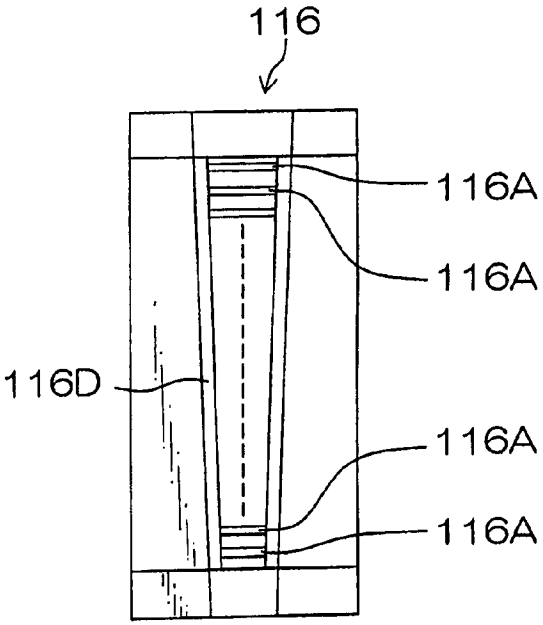
FIGS. 12A to 12C are views showing another mode of the tip end part of the nozzle.
Figure 12B:
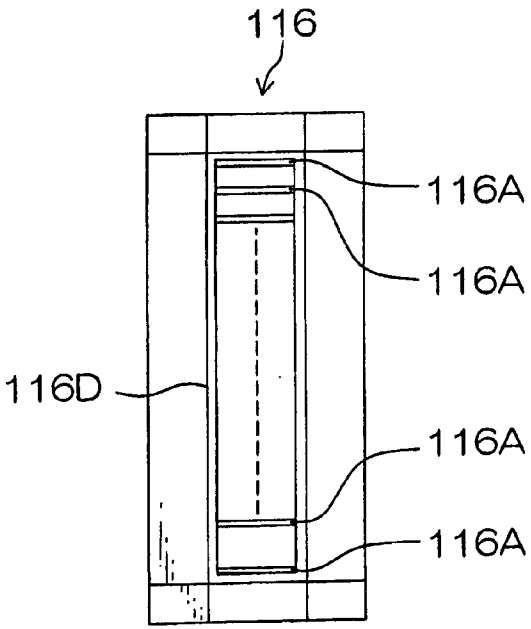
Figure 12A:
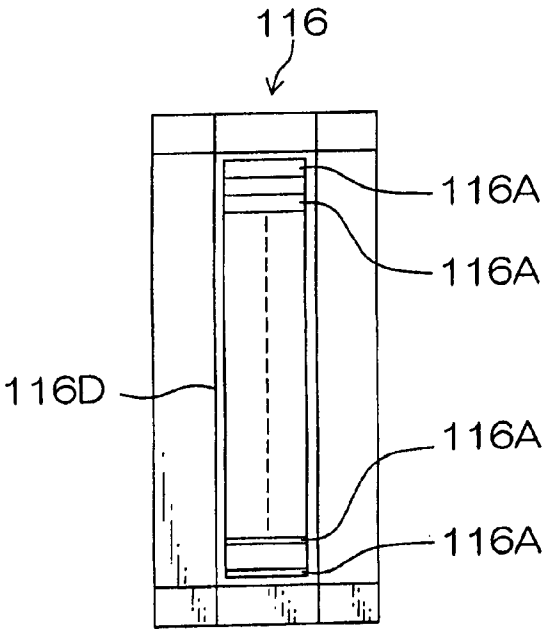
Figure 13:
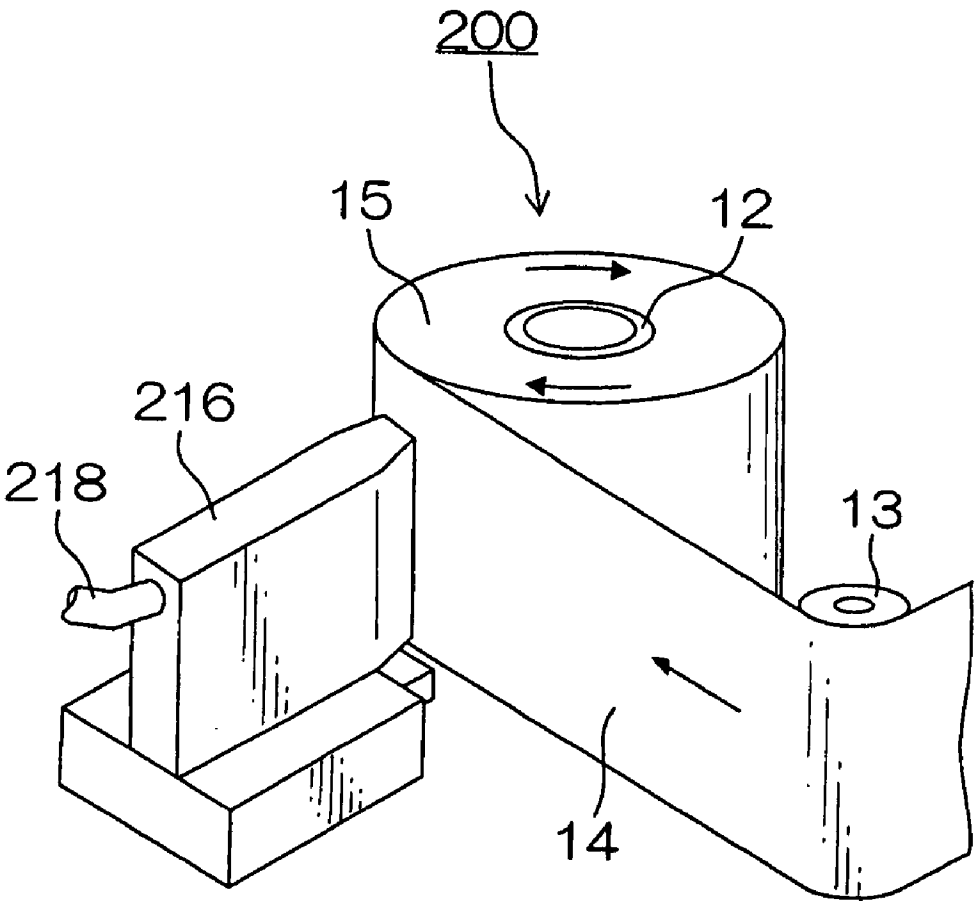
FIG.13 RELATED ART
FIG. 13 is a perspective view showing a winding apparatus of a related art.
Figure 14:
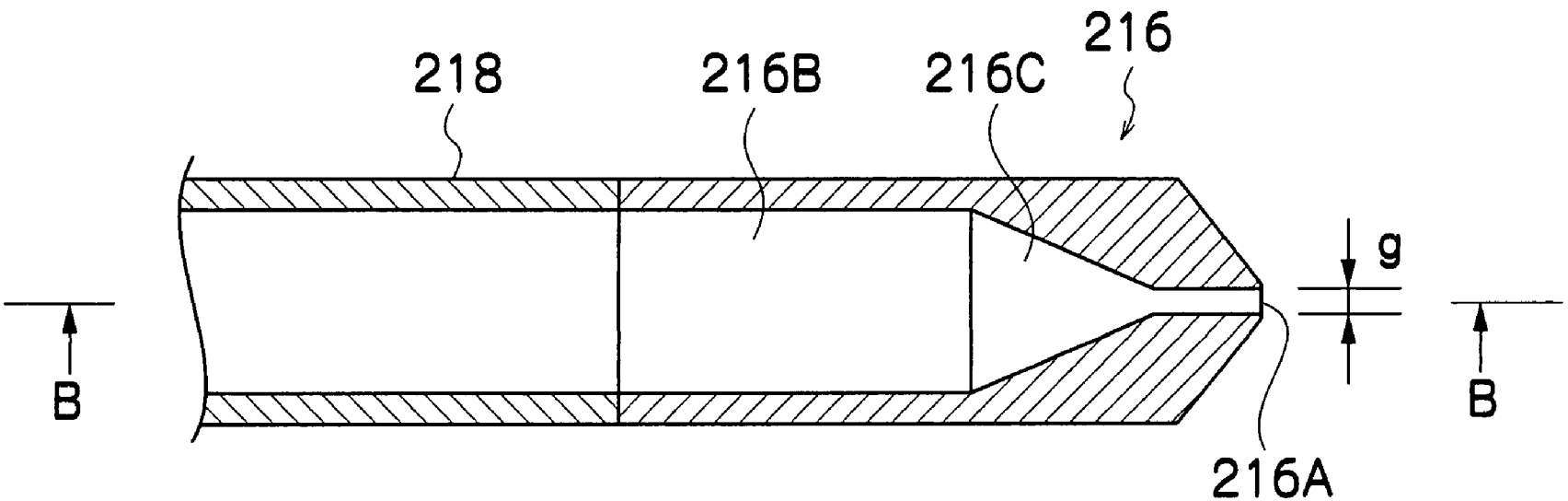
FIG.14 RELATED ART
FIG. 14 is a sectional view of a nozzle shown in FIG. 13.
Figure 15:
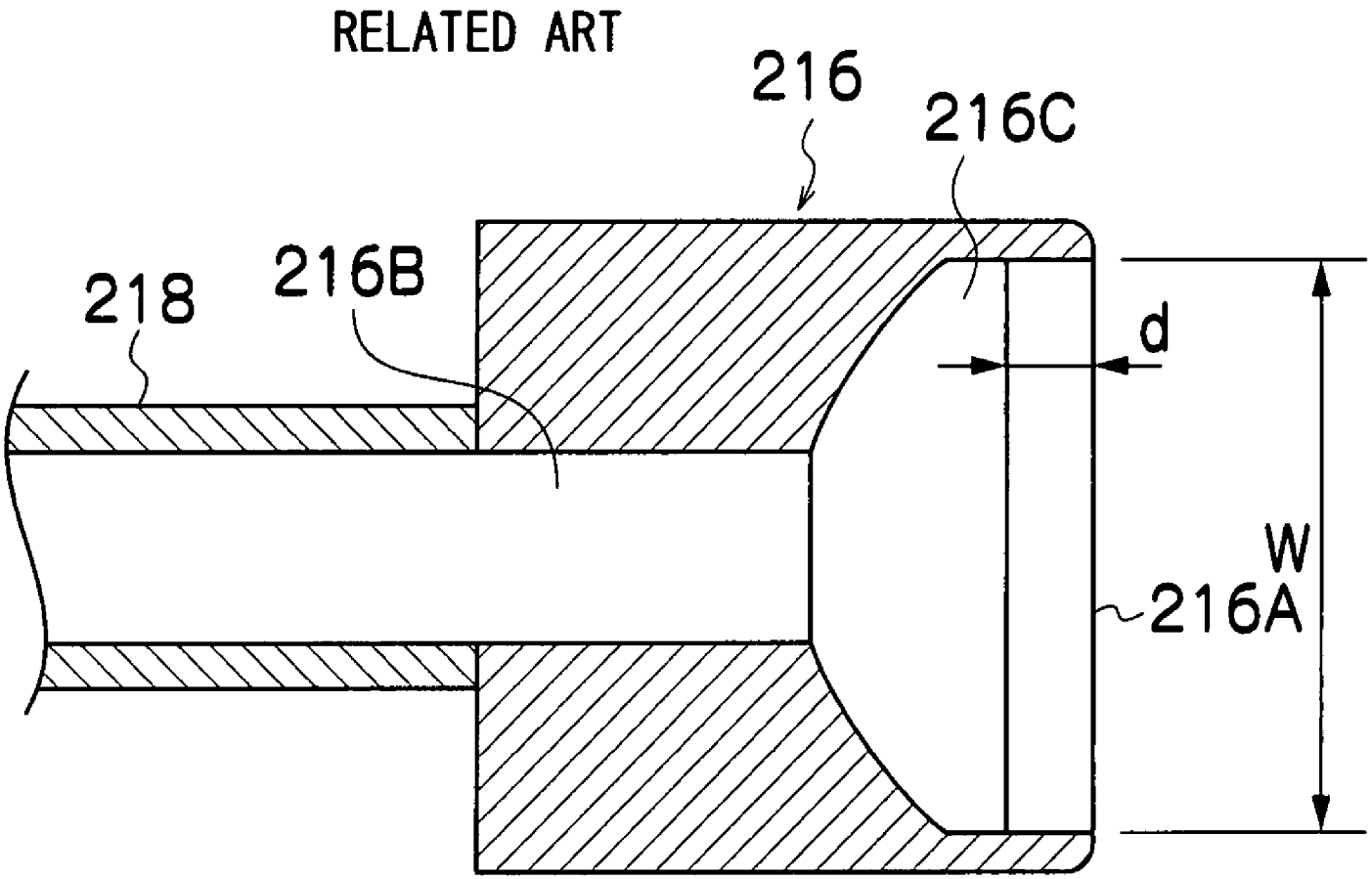
FIG.15 RELATED ART
FIG. 15 is a sectional view taken along the B—B line in FIG. 14.

FIGS. 12A, 12B and 12C are views showing another mode of the tip end part of the nozzle. Among them, FIG. 12A is the mode of the above-described 1), namely, the mode in which the width (slit space) of the slit 116A decreases toward the lower part from the upper part. FIG. 12B is the mode of the above-described 2), namely, the mode in which the space between he slits 116A and 116A (pitch of the slits) increases toward the lower part from the upper part. FIG. 12C is the mode of the above-described 3), namely, the mode in which the opening length of the slit 116A decreases toward the lower part from the upper part.

By adopting the nozzle in such a mode, the force for pressing the tape can be changed in the width direction of the tape, and therefore, when the tape is wound up, the tape can be wound up by reliably moving it to one side of the winding shaft, whereby, the tape roll with a favorable winding shape can be obtained.

Further, in this embodiment, the tip end of the nozzle 116 is only formed into the recessed R shape to follow the outer peripheral surface of the tape roll 15, and the tip end part of the nozzle 116 where the slits 116A, 116A are formed is in the plane shape as shown in FIGS. 11A and 11B, but this part can be also formed into the recessed R shape which follows the outer peripheral surface of the tape roll 15. Such an R shape requires some idea in machining, but is preferable because the effect of the present invention can be exhibited more.

What is claimed is:

1. A tape winding apparatus comprising a winding shaft which winds up a tape and forms a tape roll, and a nozzle which sprays a gas toward an outer peripheral surface of the tape roll on an occasion of winding up the tape, wherein a recessed blowout part is formed at a tip end part of the nozzle, and in the blowout part, a plurality of slits extending in a width direction of the tape are disposed at predetermined spaces from each other in a traveling direction of the tape.

2. The tape winding apparatus according to claim 1, wherein length of the blowout part in the width direction of the tape is 20% to 120% of the tape width.

3. The tape winding apparatus according to claim 2, wherein opening length of the slit is 20% to 120% of the tape width.

4. The tape winding apparatus according to claim 3, wherein a level difference of the blowout part is 0.05 mm to 3.0 mm.

5. The tape winding apparatus according to claim 4, wherein two of the slits are provided, a side slit which connects both end parts of the slits is provided, and an annular slit is formed at a tip end of the nozzle by these slits.

6. The tape winding apparatus according to claim 5, wherein the tip end of the nozzle is formed into a recessed shape which follows an outer peripheral surface of the tape roll.

7. The tape winding apparatus according to claim 1, wherein opening length of the slit is 20% to 120% of the tape width.

8. The tape winding apparatus according to claim 7, wherein a level difference of the blowout part is 0.05 mm to 3.0 mm.

9. The tape winding apparatus according to claim 8, wherein two of the slits are provided, a side slit which connects both end parts of the slits is provided, and an annular slit is formed at a tip end of the nozzle by these slits.

10. The tape winding apparatus according to claim 9, wherein the tip end of the nozzle is formed into a recessed shape which follows an outer peripheral surface of the tape roll.

11. The tape winding apparatus according to claim 1, wherein a level difference of the blowout part is 0.05 mm to 3.0 mm.

12. The tape winding apparatus according to claim 1, wherein two of the slits are provided, a side slit which connects both end parts of the slits is provided, and an annular slit is formed at a tip end of the nozzle by these slits.

13. The tape winding apparatus according to claim 1, wherein the tip end of the nozzle is formed into a recessed shape which follows an outer peripheral surface of the tape roll.

14. A tape winding apparatus comprising a winding shaft which winds up a tape and forms a tape roll, and a nozzle which sprays a gas toward an outer peripheral surface of the tape roll on an occasion of winding up the tape, wherein a recessed blowout part is formed at a tip end part of the nozzle, and in the blowout part, a plurality of slits extending in a traveling direction of the tape are disposed at predetermined spaces from each other in a width direction of the tape.

15. The tape winding apparatus according to claim 14, wherein length of the blowout part in the width direction of the tape is 20% to 120% of the tape width.

16. The tape winding apparatus according to claim 15, wherein length of a range where a plurality of the slits are disposed in the width direction of the tape is 20% to 120% of the tape width.

17. The tape winding apparatus according to claim 16, wherein a level difference of the blowout part is 0.05 mm to 3.0 mm.

18. The tape winding apparatus according to claim 17, wherein a tip end of the nozzle is formed into a recessed shape which follows an outer peripheral surface of the tape roll.

19. The tape winding apparatus according to claim 14, wherein length of a range where a plurality of the slits are disposed in the width direction of the tape is 20% to 120% of the tape width.

20. The tape winding apparatus according to claim 19, wherein a level difference of the blowout part is 0.05 mm to 3.0 mm.

21. The tape winding apparatus according to claim 20, wherein a tip end of the nozzle is formed into a recessed shape which follows an outer peripheral surface of the tape roll.

22. The tape winding apparatus according to claim 14, wherein a level difference of the blowout part is 0.05 mm to 3.0 mm.

23. The tape winding apparatus according to claim 14, wherein a tip end of the nozzle is formed into a recessed shape which follows an outer peripheral surface of the tape roll.

* * * * *